US008763694B2

(12) United States Patent
Pipchuk et al.

(10) Patent No.: US 8,763,694 B2
(45) Date of Patent: Jul. 1, 2014

(54) ZONAL TESTING WITH THE USE OF COILED TUBING

(75) Inventors: Douglas Pipchuk, Calgary (CA); Hubertus V. Thomeer, Houston, TX (US); Christopher Sarvari, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 566 days.

(21) Appl. No.: 12/811,876

(22) PCT Filed: Jan. 9, 2009

(86) PCT No.: PCT/US2009/030550

§ 371 (c)(1),
(2), (4) Date: Oct. 6, 2010

(87) PCT Pub. No.: WO2009/089416

PCT Pub. Date: Jul. 16, 2009

(65) Prior Publication Data

US 2011/0017448 A1 Jan. 27, 2011

Related U.S. Application Data

(60) Provisional application No. 61/020,529, filed on Jan. 11, 2008.

(51) Int. Cl.
*E21B 47/06* (2012.01)

(52) U.S. Cl.
USPC ..... 166/250.07; 166/250.17; 166/77.2

(58) Field of Classification Search
USPC ..... 166/250.17, 250.07, 77.2
See application file for complete search history.

(56) References Cited

U.S. PATENT DOCUMENTS

| | | | |
|---|---|---|---|
| 2,816,440 | A | 8/1955 | Moosman |
| 2,863,511 | A | 12/1958 | Moosman |
| 3,308,887 | A | 3/1967 | Nutter |
| 3,417,827 | A | 12/1968 | Smith et al. |
| 3,722,589 | A | 3/1973 | Smith et al. |
| 4,320,800 | A | 3/1982 | Upchurch |
| 4,984,634 | A | 1/1991 | Pilla |
| 5,350,018 | A | 9/1994 | Sorem et al. |
| 5,351,533 | A | 10/1994 | Macadam et al. |

(Continued)

FOREIGN PATENT DOCUMENTS

| | | |
|---|---|---|
| EP | 0699819 B1 | 1/2003 |
| EP | 1693547 B1 | 4/2010 |

(Continued)

OTHER PUBLICATIONS

Prouvost, Laurent P. and Economides, Micheal J., "Real-Time Evaluation of Matrix Acidizing Treatments", Journal of Petroleum and Engineering, 1 (1987) 145-154, Elsevier Science Publishers B. V., Amsterdam—Printed in the Netherlands.

*Primary Examiner* — Nicole Coy
(74) *Attorney, Agent, or Firm* — Michael Flynn; Tim Curington; Robin Nava

(57) ABSTRACT

A method and apparatus for measuring formation properties comprising coiled tubing fitted with a bottom hole assembly, wherein said bottom hole assembly comprises means to measure formation fluid properties, means to transmit said formation fluid properties to a surface monitoring system, means to isolate a section of a wellbore, and means to control the flow of fluid entering said coiled tubing.

19 Claims, 2 Drawing Sheets

(56) References Cited

U.S. PATENT DOCUMENTS

| | | | | |
|---|---|---|---|---|
| 5,361,836 | A | 11/1994 | Sorem et al. | |
| 5,398,755 | A | 3/1995 | Eslinger et al. | |
| 5,439,053 | A | 8/1995 | Eslinger et al. | |
| 5,503,014 | A | 4/1996 | Griffith | |
| 5,507,341 | A | 4/1996 | Eslinger et al. | |
| 5,605,195 | A | 2/1997 | Eslinger et al. | |
| 5,613,555 | A | 3/1997 | Sorem et al. | |
| 5,803,186 | A | 9/1998 | Berger et al. | |
| 6,325,146 | B1 | 12/2001 | Ringgenberg et al. | |
| 6,332,499 | B1 | 12/2001 | Kobylinski et al. | |
| 6,364,368 | B1 | 4/2002 | Kilgore | |
| 6,474,701 | B1 | 11/2002 | Bowles et al. | |
| 6,497,290 | B1 | 12/2002 | Misselbrook et al. | |
| 6,527,052 | B2 * | 3/2003 | Ringgenberg et al. | 166/336 |
| 6,561,278 | B2 | 5/2003 | Restarick et al. | |
| 6,675,892 | B2 | 1/2004 | Kuchuk et al. | |
| 6,766,853 | B2 | 7/2004 | Restarick et al. | |
| 6,892,829 | B2 | 5/2005 | Livingstone | |
| 6,959,763 | B2 * | 11/2005 | Hook et al. | 166/250.17 |
| 7,191,844 | B2 | 3/2007 | Kenison et al. | |
| 7,637,539 | B2 | 12/2009 | McKee et al. | |
| 7,849,920 | B2 | 12/2010 | Kannan et al. | |
| 2002/0148611 | A1 * | 10/2002 | Williger et al. | 166/297 |
| 2004/0194950 | A1 | 10/2004 | Restarick et al. | |
| 2007/0044960 | A1 | 3/2007 | Lovell et al. | |

FOREIGN PATENT DOCUMENTS

| | | | |
|---|---|---|---|
| FR | 2648863 | A1 | 12/1990 |
| WO | 2004099565 | A1 | 11/2004 |
| WO | 2005068769 | A2 | 7/2005 |

* cited by examiner

ZONAL TESTING WITH THE USE OF COILED TUBING

CROSS REFERENCE TO RELATED APPLICATION

This application claims priority to co-owned, co-pending U.S. Provisional Patent Application No. 61/020,529, filed Jan. 11, 2008 and incorporated herein by reference in its entirety.

FIELD OF DISCLOSURE

The present application is generally related to the use of coiled tubing equipment fitted with a novel combination of coiled tubing tools in an oil and gas well, and more particularly to methods and apparatus associated with the testing of an oil and gas well without the need for a costly and time consuming Drillpipe Stem Test (DST). Novel methods and systems to perform a DST like test on a well using a combination of coiled tubing and downhole tools will be discussed in the present disclosure by way of several examples that are meant to illustrate the central idea and not to restrict in any way the disclosure.

BACKGROUND

Currently the best way to understand reservoir boundaries and their properties is to do a Drillpipe Stem Test. This operation consists of lowering a bottom hole assembly (BHA) with sensors down the wellbore on drill pipe. It is a costly and time consuming operation. With high daily cost drilling rigs (such as but not limited to offshore and deep water rigs) doing a DST is (most of the time) too costly, with the cost being directly associated with the time it takes to do the test. When a DST is imperative to understand complex reservoirs or to estimate reserves, it is often done only in the zones with the greatest chances of success and smaller zones that could still produce a substantial amount of hydrocarbons are neglected as it may be cost prohibitive to perform a DST on these additional zones. Currently the overwhelming majority of DSTs where more than one zone per well are tested are performed by testing one zone per "trip in the hole", that is only one zone gets tested each time the drillpipe descends into the wellbore.

If information is required from multiple zones of lesser interest, the industry will typically use tools like the Modular Dynamic Tester (MDT), a mark of Schlumberger, tool to assess the zone potential. This method consists of drawing out a small amount of fluid from the formation (usually a few cubic centimeters to a couple of gallons at a maximum) and trying to measure or infer true formation pressure. On one side of the spectrum we have a full DST that involves flowing a substantial amount of formation fluid for extended periods of time to be able to measure or model formation parameters such as pressure, boundaries, skin, permeability, damage, etc. On the other side of the spectrum we have MDT-like measurements where only a comparatively small amount of formation fluid is drawn out and some of the same formation parameters are measured or modeled.

What is needed is a way to use a more efficient system like coiled tubing to deploy the BHA and perform these tests on several zones in one "trip in the hole". The associated time savings would allow many additional operators to perform a DST on their wells or to increase the number of zones where drillpipe stem testing is being performed. This will increase the knowledge of the reservoir properties, help quantify reserves more accurately and increase the chances of finding more producing zones within the same well.

The idea to use coiled tubing as a means to do a DST test is not new but it faces many safety challenges including but not limited to flowing hydrocarbons to the surface through the coil of the coiled tubing unit. Some of the U.S. Patents or Patent Applications that describe multi-zonal testing systems (and which are incorporated herein by reference) are: U.S. Pat. No. 6,959,763 entitled "Method and apparatus for integrated horizontal selective testing of wells" by Hook and Ramsey; U.S. Pat. No. 6,675,892, entitled "Well Testing Using Multiple Pressure Measurements" by Fikri Kuchuk, et al.; U.S. Pat. No. 7,191,844 entitled "Inflate control system for inflatable straddle stimulation tool" by Kenison et al.; U.S. Patent Application Publication No. 20070044960 titled "Methods, systems and apparatus for coiled tubing testing" by Lovell et al.; and U.S. patent application Ser. No. 11/960,852, filed Dec. 20, 2007, entitled "System and method for optimizing production in a well" by Kannan et al.

Once the formation fluid "exits" the well bore there is only one barrier, the wall of the coiled tubing, to contain the flowing fluid (which may possibly include flammable or toxic hydrocarbons or other materials such as hydrogen sulfide gas). The practice of having only one barrier, especially when that barrier is the coiled tubing itself, is not an approved practice in the industry due to the potential catastrophic consequences of a rupture in the coiled tubing and subsequent release of hydrocarbons or other hazardous materials into the atmosphere. Therefore, although the idea of using coiled tubing to flow a well to surface and to use it as a DST string has been explored in other patents, these patents typically describe unpractical methods (having little or no chance of being used due to safety concerns) or by using what is known in the industry as a dual coil (i.e. concentric coiled tubings) type of equipment.

The present invention proposes that the formation test done in coiled tubing as a solution to the two issues discussed above: the efficiency of a system that can test several zones in a single trip in the hole and a system that will be able to test (draw out) many times over the volume of tools like the MDT tool but without the risk inherent to flowing hydrocarbons to the surface.

SUMMARY OF THE DISCLOSURE

An apparatus for testing hydrocarbon bearing formations that includes coiled tubing, a bottom hole assembly attached to the coiled tubing, the coiled tubing bottom hole assembly including means to isolate the formation to be tested, means for restricting the volume of formation fluid drawn from the formation allowed to enter the coiled tubing to prevent substantial quantities of the formation fluid from reaching the surface, and means for measuring the formation pressure and temperature.

Also a method for testing a hydrocarbon formation including: deploying coiled tubing fitted with a bottom hole assembly in a wellbore that intersects the hydrocarbon formation, allowing formation fluid from the hydrocarbon formation to enter the coiled tubing, stopping the flow of formation fluid before a substantial quantity of the formation fluid reaches the surface through the coiled tubing, and measuring changes in pressure of the formation fluid.

Further, an apparatus for testing hydrocarbon bearing formations using coiled tubing and a bottom hole assembly (BHA) including:

i) A realtime measurement sub that houses a pressure measurement sensor to read tubing pressure, annulus pressure and the pressure below a packer, a casing collar locator sensor and a temperature sensor;

ii) A disconnect sub, for disconnecting the coiled tubing from the BHA below the disconnect sub;

iii) A pump through flapper safety valve;

iv) A ported drain sub;

v) A memory gauge carrier sub;

vi) A coiled tubing jar sub;

vii) A retrievable hydraulically set packer;

viii) A burst disk sub;

ix) A perforating gun firing head; and x) A perforating gun.

Also a method for testing hydrocarbon bearing formations using coiled tubing and a bottom hole assembly (BHA), including the steps of:

i. Running the BHA into the well with nitrogen inside the coiled tubing and positioning it at the required depth;

ii. Setting a retrievable hydraulically set packer at a predetermined pressure setting by pressurizing the nitrogen in the tubing;

iii. Increasing the coiled tubing's internal pressure to open a burst disc sub;

iv. Sending a predetermined sequence of pressure signals/pulses downhole to deliver a firing code to a programmed perforating gun firing head instructing it to arm and subsequently fire perforating guns, v. Bleeding down the internal coiled tubing pressure to a predetermined pressure during a preprogrammed delay between the firing head receiving the firing command to the actual firing of the perforating guns, vi. Waiting for the perforating guns to fire;

vii. Allowing reservoir zone fluid to flow into the coiled tubing;

viii. Monitoring the coiled tubing pressure at the surface to restrict flowback of reservoir fluid through the coiled tubing beyond the surface;

ix. Closing a pump through flapper safety valve by pressuring the annulus of the coiled tubing string above the packer;

x. Monitoring pressure and temperature using a real time measuring sub;

xi. Once the pressure build up has stabilized to the desired rate, matching the pressure below the packer with the pressure in the coiled tubing annulus and releasing the retrievable hydraulically set packer using a jar;

xii. Circulating fluid down the coiled tubing string to displace the reservoir fluid; and xiii. Pulling the coiled tubing string and the BHA out of the well.

Furthermore, a method for testing a hydrocarbon bearing formation using coiled tubing and a bottom hole assembly (BHA) including:

i) Lowering and positioning the BHA at the desired depth to perform the test;

ii) Setting a retrievable hydraulically set packer;

iii) Firing a perforating gun;

iv) Restricting the amount of formation fluid drawn out from the reservoir to a predetermined volume so as not to allow fluid to reach the surface by restricting the internal coiled tubing pressure at the time of firing the perforating gun;

v) Measuring the formation pressure until a required stabilization rate is achieved;

vi) Unsetting the packer;

vii) Circulating fluid out of the coiled tubing; and viii) Retrieving the coiled tubing and the BHA out of the well.

Also, an apparatus for measuring formation properties including coiled tubing fitted with a bottom hole assembly, wherein the bottom hole assembly comprises means to measure formation fluid properties, means to transmit the formation fluid property measurements to a surface processing unit, means to isolate a section of a wellbore, and means to control the flow of fluid entering the coiled tubing.

Further, a method to measure properties of a formation including:

i) Positioning a bottom hole assembly lowered by coiled tubing at the formation, the bottom hole assembly including means to measure formation fluid properties, means to transmit the formation fluid properties to a surface processing unit, means to isolate a section of a wellbore, and means to control the flow of fluid entering the coiled tubing, ii) Isolating the formation, iii) Allowing a predetermined volume of formation fluid to enter the coiled tubing, iv) Sealing the coiled tubing at the bottom hole assembly, v) Monitoring the pressure and temperature of the formation, vi) Relating the pressure and temperature to a surface processing unit; and vii) Retrieving the bottom hole assembly once a desirable pressure rate is achieved.

DETAILED DESCRIPTION OF THE DISCLOSURE

Figure 1:
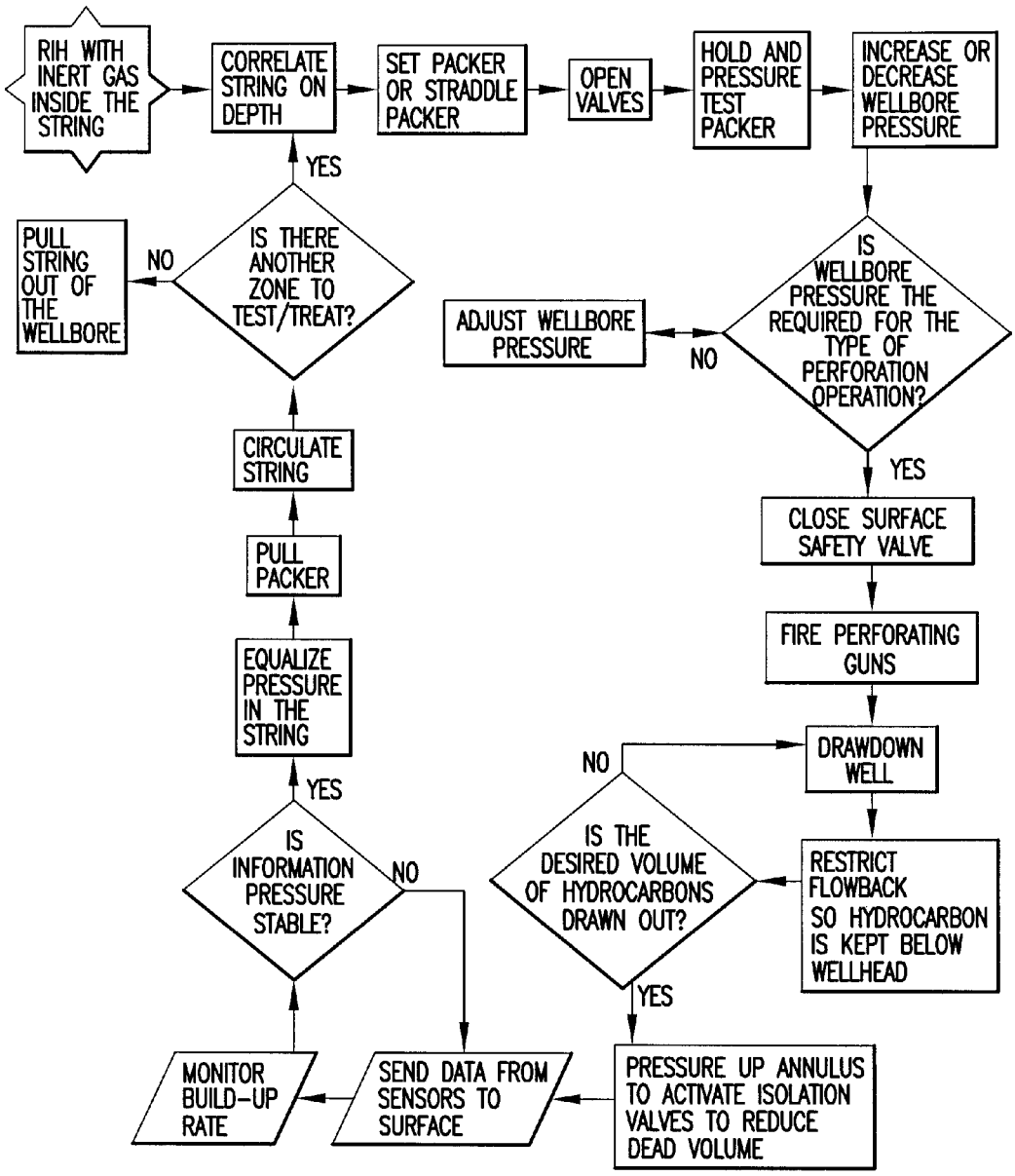
FIG. 1 illustrates procedures associated with one embodiment of the disclosed method.
Figure 2:
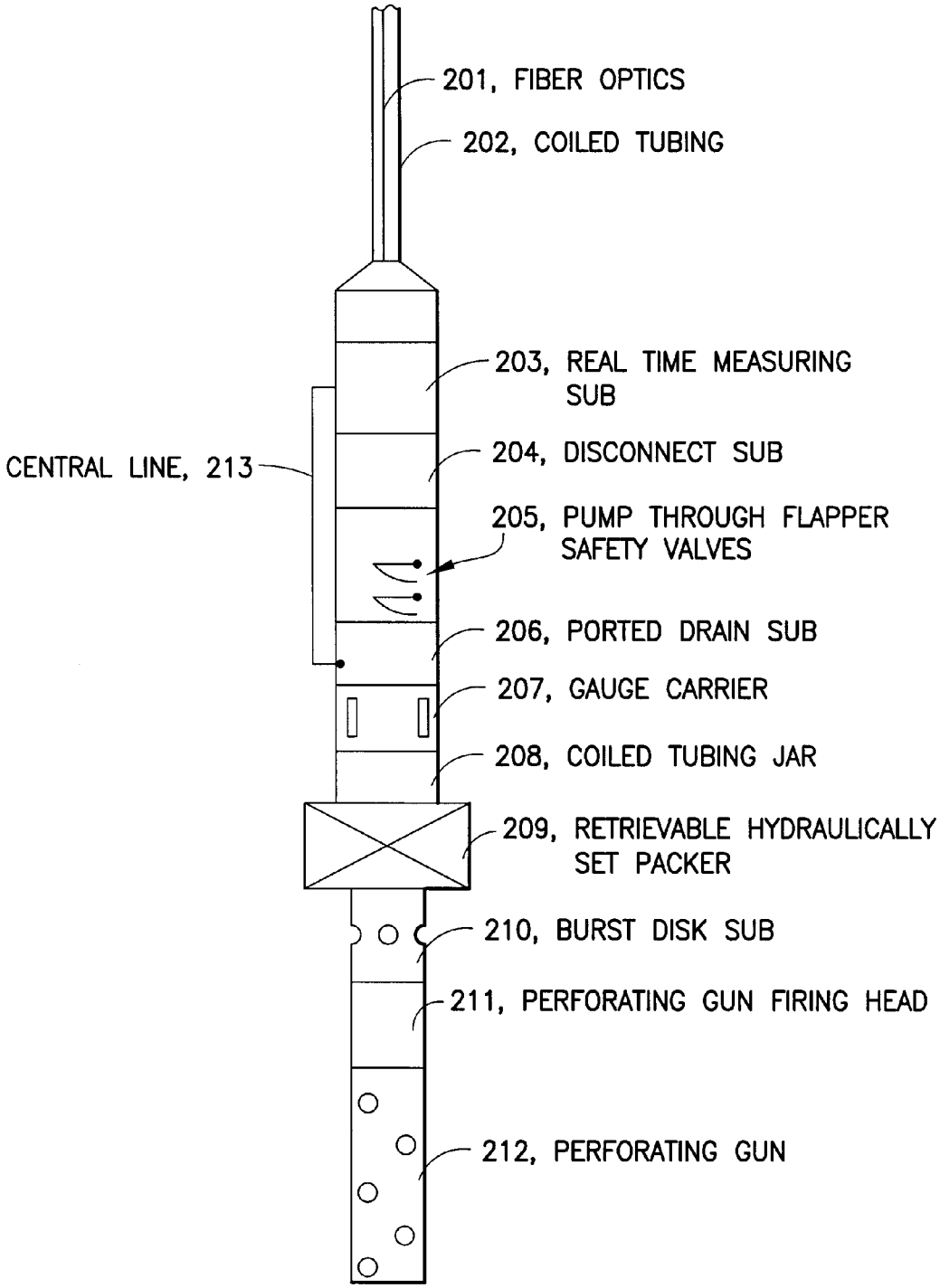
FIG. 2 illustrates an example bottom hole assembly that may be used to perform the disclosed method.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The following embodiments provide examples and do not restrict the breath of the disclosure and will describe ways to test a particular formation without the need to perform a Drill Stem Test by using coiled tubing equipment. Further features and advantages of the disclosure will become more readily apparent from the following detailed description when taken in conjunction with the accompanying drawings.

The general concept is to lower a coiled tubing string with a BHA including sensors, means to transmit the information in real time to a surface acquisition system and with at least one packer to isolate or straddle the zone to be tested or flowed. The BHA string may or may not also include perforating guns and/or propellants.

Once the testing BHA is in place at the required depth to test the zone, the packer(s) is/are set to isolate the zone to be tested from the rest of the wellbore forming what is known in the industry as a closed chamber, proper function of BHA sensors is tested, a set of isolation/safety valves are operated to ensure the integrity of the coil and the pressure of the "closed chamber" is adjusted to the desired pressure. By manipulating the initial pressure of the closed chamber before perforating the wellbore's casing, a multitude of perforating techniques can be applied. Some of these techniques are, but are not limited to, Extreme Under Balance (EUB), Under Balance (UB), Extreme Over Balance (EOB), Over Balance (OB), and facilitating initial pressure requirements for perforating techniques such as Schlumberger's PURE (a mark of Schlumberger) perforating process, etc. The perforating gun in the string is initiated to open the formation to the wellbore. The perforating operation could be carried out in the same trip or in a previous trip in the hole. Communication from the downhole sensors to the surface acquisition system is monitored in real time and continuously. A secondary memory set of sensors may be placed in the BHA.

Once the equipment is in place, communication from the wellbore to the inside of the coiled tubing is enabled. There are a multitude of ways to achieve this communication, by ways of example but not to limited the present disclosure, a sub with what is commonly known in the industry as a burst disk or using shear pins where the disks/shear pins rupture at a predetermined pressure inside the coiled tubing BHA allowing the entry of fluid from the wellbore into the coiled tubing may be used. In the present disclosure, the volume of fluid that is allowed to enter the coiled tubing is restricted to such a volume that precludes any well effluent from reaching the surface. The volume of formation fluid that will be allowed to enter the coil is predetermined by calculating the volume of the coiled tubing that is inside the well, the density of the fluid that was originally inside the coiled tubing before allowing communication to the wellbore fluid, the density of the fluid entering the coiled tubing from the formation/wellbore and the initial pressure of both fluids before allowing communication or simply by mechanical means such as a valve installed in the coiled tubing at a predetermined depth close to surface that can be remotely operated. It is in this way that the formation fluid does not reach the surface, which is the safety concern in these type of operations. The restriction of fluid also serves to evaluate the formation response. By knowing how much fluid was drawn out of the formation and the time required to reach a stable pressure, formation properties can be modeled or estimated.

After the measurements objectives are achieved, the formation fluid is then forced down out of the coil. This could be done before or after unsetting the packer/straddle packer. Once the formation fluid is flushed out of the coil and back into the wellbore, the coiled tubing and the BHA are retrieved from the borehole.

In a preferred embodiment shown in FIG. 1, a coiled tubing string is lowered within the wellbore to the depth of the formation to be tested. This is described in FIG. 1 as being "run in hole" (RIH). The coiled tubing string comprises a BHA that includes sensors to measure parameters such as, but not limited to, pressure, temperature, flow, viscosity, volume, a casing collar locator (CCL), a Gamma-Ray sensor, among others as seen fit in the operation. Measurements from the sensors can be recorded at preset time intervals or in real time and the information may be further transmitted to an acquisition system located at surface. The coiled tubing's BHA may also include a packer or a straddle packer and isolation valves to perform multiple functions. The packer is set to isolate the annulus between the coiled tubing and the wellbore; and the formation to be tested/flowed from the rest of the wellbore. The assembly may also include a perforating gun and related equipment such as a firing head, to create a communication path between the well bore and the formation by means of a multitude of shaped charges; the length, phasing, shots per foot and size of the perforating gun will vary depending of the well construction and the objective of the operation. A person skilled in the art will understand the large variety of perforating operations that might be performed with coiled tubing. The coiled tubing is often filled with an inert gas such as, but not limited to, Nitrogen as it is run in hole. The perforating gun is correlated in depth and positioned in front of the desired interval.

Once the coiled tubing string is in the desired position, the packer/straddle packers are set to isolate the formation to be tested. There are several ways to achieve the setting of packer/straddle packers in use in the industry, by way of an example and not to limit the present disclosure, one method to set such packer/straddle packers is by over pressuring the coil. Other common methods used are rotating and/or compressing a mechanically set packer. The packer/straddle packer is then tested for pressure integrity before continuing the operation. The hydrostatic pressure of the formed "closed chamber", known in the industry as the volume of the borehole that is below the packer or in between the straddle packers, is lowered or increased to the desired pressure to a pre-determined value in order to achieve OB, EOB, UB, EUB or initial pressure requirements for the desired perforating technique such as PURE (mark of Schlumberger). Then a signal is sent to fire the perforating guns. This signal can be sent in the form of pressure pulses, directly from the surface acquisition system through the telemetry lines, via wireless or electromagnetic signals to a receptor generally located on top and/or bottom of the perforating guns. After the perforating guns have fired, the flow of formation fluid from the formation is restricted to a known and pre-determined volume in order to ensure the formation fluid is kept below the surface or wellhead. A surface valve could be used to restrict the flow back volume. Once the desired controlled volume is drawn down from the formation, a set of down hole valves located in the coiled tubing BHA are closed; these valves can be activated in a multitude of ways well understood within the industry; for example by the pressuring up of the annulus formed between the coiled tubing and the casing above the top packer or by pressuring up the annulus, a valve such a flapper valve is activated to its closed position. There are several other valves in the industry that could alternatively be used that can be activated by other means such as pressure pulses, wireless signals or signals from a surface acquisition system through the telemetry lines, just to name a few of the technologies currently available to activate such valves to an open or close position and that a person skill in the art will recognize as valves able to perform the required operation. The valve is closed to add another layer of safety by isolating the formation fluid that could possibly carry hydrocarbons to the surface, and to reduce the "dead volume" as to shorten the time required to reach a stabile formation pressure within the closed chamber. As the fluid that is drawn out of a formation may contain free gas or gas that is in solution, it becomes a compressible fluid. It is for this reason that the smaller the volume of formation fluid that is closed (also called dead volume) to the test, the less time it will take for the pressure to stabilize. The formation pressure build-up rate is monitored in real time by the acquisition system located at surface. The coiled tubing's BHA may also include memory pressure and temperature sensors. An optional "injectivity" test, such as but not limited to a "leak off" test, can also be performed at this time.

Once the desired stabilization rate is achieved, the valves in the coiled tubing BHA are activated to the required position to equalize the pressures inside and outside the coiled tubing, on top and below the packer, or inside and outside the straddle packers. The packer/straddle packers are now unset and the coiled tubing string is circulated to flush out any formation fluid that has entered the coil. The coiled tubing BHA may now be removed from the wellbore.

In another embodiment, a coiled tubing string is lowered into the wellbore to the depth of the formation to be tested and flowed. The coiled tubing string comprises a BHA that includes sensors to measure a multitude of parameters such as, but not limited to, pressure, temperature, flow, viscosity, volume, etc. The BHA may include a packer or a straddle packer and isolation valves to perform multiple functions. The packer is set to isolate the annulus between the coil and the wellbore; and the formation to be tested/flowed from the rest of the wellbore. After the pressure integrity of the packer is tested, the formation fluid is allowed to flow into the coiled tubing until a desired and predetermined volume has been drawn out of the formation, a series of isolation/safety valves located in the coiled tubing BHA are operated at this point to shut off the fluid flowing from the formation into the coiled tubing. The sensors located in the coiled tubing BHA measures (among other parameters) the temperature and pressure of the formation, relating in preset time intervals the information to an acquisition system at surface until the desired information is acquired. After the test has finished the isolation/safety valves are operated to its open position and a "killing fluid" (a heavy or high density/viscosity fluid) is pumped down the coiled tubing to displace the hydrocarbon inside the coiled tubing. The processes described above are repeated as many times as the zones to be tested.

The perforations used as a means to flow the formation to be able to test it could be left open or, if required, the perforations could be sealed depending of the need for subsequent operations. The perforations could either be temporarily sealed or permanently sealed during the same run in hole. The seal could be achieved by means of a sealing apparatus, such as a sleeve or a patch, set on the perforations and/or a viscous fluid and/or particulate packing and/or a chemical reaction which produces a compound to set into the formation to produce a seal across the perforations.

A variant embodiment of the present novel disclosed method aims to help gather the information needed to understand the downhole pressure of a reservoir. The below disclosed method could be used for a single zone or for multiple zones as needed. To better understand the many different reservoir characteristics within a reservoir the particular zone to be tested must have fluid drawn from it in a significant enough volume to ensure that the pressure measurements made are as close to accurate as is needed in the study at hand. Once the fluid is drawn from the reservoir to a recordable pressure reduction, the zone is isolated from the rest of the other zones and the pressure build up is monitored. The zone is isolated by setting a packer or straddle packer that are part of the coiled tubing BHA that is lowered to the zone to be tested via a coiled tubing. The BHA may also contain sensors and isolation valves. When the pressure build up is stabilized, the procedure is either repeated or the particular zone is injected with a fluid and the injectivity pressure profile is recorded.

A method of performing the above disclosed novel embodiment uses coiled tubing 202 fitted on its end with a BHA, the BHA includes a real time measuring sub 203, a disconnect sub 204, a series of pump through flapper safety valves 205, a ported drain sub 206, a gauge carrier 207 fitted with pressure and temperature memory gauges, coiled tubing jars 208, a retrievable hydraulically set packer 209, a burst disk sub 210, a perforating gun firing head 211 and a perforating gun 212.

The BHA is run into the well with the coiled tubing 202 filled with nitrogen or an inert gas. The BHA is run to a predetermined depth where the zone of interest is to be tested. Accurate depth correlation can be achieved by using a conventional casing collar locator (CCL) and/or gamma ray sensor housed in the real time measuring sub 203, both techniques are widely known and used in the art. A retrievable hydraulically set packer 209 is set at a predetermined pressure setting by pressurizing the nitrogen within the coiled tubing. Alternate methods such as using a second firing head and a firing tool could also be used to set the packers 209.

After the retrievable hydraulically set packers 209 are set, the pressure inside the coiled tubing 202 is increased to rupture the burst disks of the burst disc sub 210 to open a flow path from the wellbore below the packer to the inside of the coiled tubing BHA. Alternatively a pressure activated sliding sleeve could be used to achieve the flow path. By maintaining or increasing the coiled tubing pressure, the packer's seal pressure integrity is tested. Once the pressure integrity of the retrievable hydraulically set packer 209 is confirmed, a predetermined sequence of pressure signals/pulses are sent downhole to deliver a firing code to a programmed perforating gun firing head 211 instructing it to arm and subsequently fire the perforating guns 212. During a preprogrammed delay between the firing head 211 receiving the firing command to the actual firing of the perforating guns 212, the internal coiled tubing 202 pressure is bled down (nitrogen or the inert gas of choice is bled out at the surface) to a predetermined desirable pressure and a safety valve located in the coiled tubing 202 at the surface is closed.

As the perforating gun 212 fires and the now isolated reservoir zone flows into the coiled tubing 202 the coiled tubing 202 internal pressure is monitored at the surface to avoid the volume of fluid flowback from the reservoir through the coiled tubing 202 to reach the surface. Once the desired formation fluid volume is drawn out of the formation to be tested, the pump through flapper safety valve sub 205 (with at least a single flapper valve) located in the coiled tubing's BHA is actuated to its closed position by pressuring up the annulus formed between the coiled tubing 202 and the casing above the retrievable hydraulically set packer 209. By closing the flapper valves in the pump through flapper safety valve sub 205 the formation fluid can no longer flow into the coiled tubing 202, effectively creating a closed chamber for a representative test of the reservoir zone to be tested.

The pressure and temperature above and below the flapper valves is monitored with the gauge carrier's 207 memory gauges and the realtime measurement sub 203 that allows the surface operator to display in realtime when the pressure build up has stabilized to a desirable rate. The means by which the surface operator is receiving the measurement data may be via a fiber optic 201 line inside the coiled tubing 202 that is connected to the realtime measurement sub 203 and the surface readout equipment. This information can also be transmitted to the surface readout equipment by other means known in the art which may include a conductor cable, a series of mud pulse or electromagnetic transceivers, etc. By using a ported drain sub 206 below the pump through flapper safety valve sub 205, the pressure and temperature from below the pump through flapper safety valve sub 205 can be transmitted to the real time measuring sub 203.

Once the pressure build up has stabilized to the desired rate of increase, an injection test into the isolated reservoir zone can be performed to measure an injection pressure profile. This injection pressure profile can be monitored with the memory gauges housed in the gauge carrier 207 and the real time measuring sub 203. Since the pressure below the retrievable hydraulically set packer 209 is known, the pressure in the annulus between the coiled tubing 202 and the casing is equalized above and below the retrievable hydraulically set packer 209, so the retrievable hydraulically set packer 209 can be released by a straight pull from the coiled tubing jar 208, if needed. Alternate ways of releasing the retrievable hydraulically set packer 209 can be used, such as rotation with an alternate sub that uses a straight pull to create rotation. In the unplanned event that the retrievable hydraulically set packer 209 cannot be released, the disconnect sub 204 may be activated to separate the BHA below the disconnect sub 204 in order to safely retrieve the coiled tubing out of the wellbore. With the retrievable hydraulically set packer 209 now unset, a desired fluid can be pumped from surface into the coiled tubing 202 string to displace the fluid drawn out of the reservoir as to fill the coiled tubing 202 down to at least the pump through flapper safety valve sub 205. The coiled tubing string and BHA can be safely removed from the well.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope of the appended claims.

We claim:

1. An apparatus for testing hydrocarbon bearing formations comprising:

coiled tubing;

a bottom hole assembly attached to said coiled tubing:

said coiled tubing bottom hole assembly comprising means to isolate said formation to be tested, means for restricting the volume of formation fluid drawn from the formation allowed to enter the coiled tubing to prevent said formation fluid from reaching the surface, the volume comprising a predetermined volume determined by calculating a volume of the coiled tubing that is inside the well, a density of the fluid in the coiled tubing before drawing fluid from the formation, a density of the formation fluid entering the coiled tubing, and the initial pressure of both fluids before allowing communication, means for measuring the formation pressure and temperature, a perforating gun and a perforating gun firing head.

2. A method for testing a hydrocarbon formation comprising:

deploying coiled tubing fitted with a bottom hole assembly in a wellbore that intersects said hydrocarbon formation;

firing a perforating gun of the bottom hole assembly to open the formation to the wellbore;

allowing a predetermined amount of formation fluid from said hydrocarbon formation to enter said coiled tubing and stopping the flow of formation fluid into the coiled tubing to prevent the formation fluid from reaching the surface through said coiled tubing, the amount of fluid determined by calculating a volume of the coiled tubing that is inside the well, a density of the fluid in the coiled tubing before drawing fluid form the formation, a density of the formation fluid entering the coiled tubing, and the initial pressure of both fluids before allowing communication; and measuring changes in pressure of said formation fluid.

3. An apparatus for measuring formation properties comprising a coiled tubing fitted with a bottom hole assembly, wherein said bottom hole assembly comprises means to measure formation fluid properties, means to transmit said formation fluid property measurements to a surface processing unit, means to isolate a section of a wellbore, means to control the flow of fluid entering said coiled tubing, wherein the flow of fluid entering the coiled tubing is a predetermined volume that is prevented from reaching the surface, the predetermined volume calculated by the apparatus based on a volume of the coiled tubing that is inside the well, a density of the fluid in the coiled tubing before drawing fluid form the formation, a density of the formation fluid entering the coiled tubing, and the initial pressure of both fluids before allowing communication;

a perforating gun and a perforating gun firing head.

4. An apparatus as in claim 3, wherein the formation properties measured are comparable to the properties needed to generate a pressure transient analysis.

5. An apparatus as in claim 3, wherein the formation fluid properties measured include pressure and temperature.

6. An apparatus as in claim 3, wherein the means to transmit the information from the bottom hole assembly to the surface comprises a conductor cable or a fiber optic cable.

7. An apparatus as in claim 3, wherein the means to isolate a section of a wellbore comprises a packer or a straddle packer.

8. An apparatus as in claim 3, wherein the means to control the flow of fluid entering the coiled tubing comprises a pump through flapper safety valve sub.

9. An apparatus as in claim 3, wherein the means to control the flow of fluid entering the coiled tubing comprises a valve located in the coiled tubing close to surface.

10. An apparatus as in claim 3, wherein the means to control the flow of fluid entering the coiled tubing comprises relieving the coiled tubing internal pressure to a pressure that will only allow a predetermined volume of formation fluid to enter the coiled tubing as to preclude said formation fluid to reach the surface.

11. An apparatus as in claim 8, wherein the pump through safety flapper valve sub has at least one flapper valve.

12. A method to measure properties of a formation comprising:

positioning a bottom hole assembly lowered by coiled tubing at said formation, said bottom hole assembly comprising means to measure formation fluid properties, means to transmit said formation fluid properties to a surface processing unit, means to isolate a section of a wellbore, means to control the flow of fluid entering said coiled tubing, a perforating gun and a perforating gun firing head;

isolating said formation;

allowing a predetermined volume of formation fluid to enter the coiled tubing, the volume of formation fluid determined by calculating a volume of the coiled tubing that is inside the well, a density of the fluid in the coiled tubing before drawing fluid form the formation, a density of the formation fluid entering the coiled tubing, and the initial pressure of both fluids before allowing communication;

sealing the coiled tubing at the bottom hole assembly to form a closed chamber within the bottom hole assembly to perform a representative test of the reservoir zone;

monitoring the pressure and temperature of the formation;

transmitting said pressure and temperature to a surface processing unit displacing the formation fluid from within the coiled tubing; and retrieving the bottom hole assembly after a desirable pressure rate of increase has been achieved.

13. A method as in claim 12, wherein isolating comprises isolating the formation with a retrievable hydraulically set packer.

14. A method as in claim 12, wherein the volume of formation fluid allowed to enter the coiled tubing is restricted by relieving the coiled tubing internal pressure to a pressure that will only allow said predetermined volume of formation fluid to enter the coiled tubing as to preclude said formation fluid to reach the surface.

15. A method as in claim 12, wherein the volume allowed to enter the coiled tubing is restricted by ways of a pump through flapper safety valve sub.

16. A method as in claim 15, wherein the pump through flapper safety valve sub is actuated close by pressuring up the annulus between the coiled tubing and the casing above the packer.

17. A method as in claim 12, wherein the predetermined volume allowed to enter the coiled tubing is restricted by closing a valve located in the coiled tubing close to surface.

18. A method as in claim 12 further comprising firing the perforating gun after isolating the formation.

19. A method as in claim 18, wherein firing the perforating gun comprises sending a predetermined sequence of pressure signals/pulses to deliver a firing code to a programmed perforating gun firing head.

* * * * *